United States Patent [19]

Okada

[11] Patent Number: 5,031,911

[45] **Date of Patent: * Jul. 16, 1991**

[54] BALL-SHOOTING GAME MACHINE

[75] Inventor: Kazuo Okada, Tokyo, Japan

[73] Assignee: Universal Co., Ltd., Japan

[ * ] Notice: The portion of the term of this patent subsequent to Apr. 2, 2008 has been disclaimed.

[21] Appl. No.: 512,999

[22] Filed: Apr. 23, 1990

Related U.S. Application Data

[63] Continuation-in-part of Ser. No. 418,346, Oct. 6, 1989, Pat. No. 5,004,238.

[30] Foreign Application Priority Data

Apr. 25, 1989 [JP] Japan ..... 1-105589

[51] Int. Cl.[5] ..... A63F 3/70

[52] U.S. Cl. ..... 273/121 B; 273/124 A

[58] Field of Search ..... 273/121 A, 121 B, 122 A, 273/123 A, 124 A, 125 A, 126 A

[56] References Cited

FOREIGN PATENT DOCUMENTS 72646 6/1977 Japan ..... 273/121 B 70639 6/1979 Japan ..... 273/121 B

*Primary Examiner*—Edward M. Coven

*Assistant Examiner*—Raleigh W. Chiu

*Attorney, Agent, or Firm*—Waldron & Associates

[57] ABSTRACT

A ball-shooting game machine having a starter hole for initiating a separate game when a game ball shot onto a game board enters into the starter hole, and a separate game device for conducting the separate game, is provided with a random number generator to produce a random number when a predetermined number of balls is shot onto the game board and the results of any separate game is determined by the value of the random number generated.

5 Claims, 5 Drawing Sheets

BALL-SHOOTING GAME MACHINE

RELATED APPLICATION

This application is a Continuation-In-Part of Application Ser. No. 07/418,346, filed Oct. 6, 1989, now U.S. Pat. No. 5,009,238.

BACKGROUND OF THE INVENTION

1. Field of the Invention

This invention relates to a ball-shooting game machine such as a pachinko game machine. More specifically, it relates to a ball-shooting game machine which includes a special winning hole, called starter hole, for initiating a separate game when a game ball shot onto a game board surface enters the winning hole, and a separate game device for conducting the separate game.

2. Description of the Prior Art

In a pachinko game machine a ball shooter is provided for shooting game balls onto a game board surface, having one or more winning holes or other winning devices, and a plurality of nails or pins which interfere with and guide the balls' travel. The object of the game is to get the balls to enter a winning hole or other winning device. It is well known that a probability of producing winning balls; i.e., getting balls to enter winning holes, is varied depending on position, orientation, and angle of nails or pins arranged on the game board surface, as well as the interval between adjacent nails. Therefore, the adjustment of nails is an important operation for a pachinko shop. For a player, on the other hand, it is most important to find a pachinko game machine which has been adjusted to provide a higher probability of producing winning balls.

There has hitherto been known a pachinko game machine having a special winning hole called starter hole or "chucker" which causes a separate game to be started by a variable display device or a variable winning device when a game ball enters the special winning hole, so that a player may be given a chance for obtaining an increased score as a result of the separate game. In such pachinko game machines, it has been proposed that the results of the separate game should be according to a predetermined probability to give the chance for obtaining high scores by the separate game to more players.

However, even if a result of the separate game provides a high score to a player on the basis of a predetermined probability, it is not assured that a winning ball will enter the starter hole, and a probability of a particular result of the separate game varies according to the number of winning balls entered into the starter hole. Further, in order to match the game machine with a well-trained player or professional, the nails disposed near the starter hole can be adversely adjusted or the starter hole is disposed at a position where a winning ball is seldom obtained, so that the number of prize balls greatly varies depending on the skill of the player. Consequently, such a game machine lacks impartiality as a game designed for the unskilled public.

SUMMARY OF THE INVENTION

An object of the invention is to provide a ball-shooting game machine which permits a specific result in a separate game based on a probability determined from detection of shot balls, independently of the number of game balls entered into a starter hole.

According to the present invention, there is provided a ball-shooting game machine comprising a ball shooter for shooting game balls onto a game board surface, a starter hole for initiating a separate game when a shot game ball enters therein, a separate game device for conducting the separate game, a shot ball detecting means for detecting a predetermined number of shot balls shot by the ball shooter, a random number generating means for producing random numbers in response to an output signal from the shot ball detecting means, a judging means for judging a value of the random number generated by the random number generating means, and a control means for controlling the separate game device to initiate the separate game if the game ball enters into the starter hole and to finish the separate game with a predetermined specific result if the value of the random number is judged a predetermined value.

The starter hole includes not only a winning hole (chucker) formed to receive a game ball but also other devices such as a pass-through chucker which a game ball can pass through. Accordingly, an entrance into the starter hole includes not only a case where a game ball enters a chucker hole, but also a case where a game ball passes through the pass-through chucker.

In one embodiment of the invention, the separate game device comprises a variable display device for variably displaying a plurality of numerals, characters, or figures, which is driven to variably display the numerals or the other figures by signals from the control means if a game ball enters into the starter hole, and to stop the variable display at a predetermined specific result corresponding to the value of the random number.

There is also disposed on the game board surface a variable or changeable winning device which can be changed from a state disadvantageous to a player to another state advantageous to a player.

In the ball-shooting game machine of the present invention, the random number generating means generates a random number whenever a predetermined number of balls (for example one) is shot from the ball shooter, then the judging means judges a value of the random number. As a result of the judgement, if the random number is a predetermined value, and if a separate game has been started, the control means controls and finishes the separate game device with a predetermined specific result. In other words, when a game ball enters (or passes through) the starter hole, the separate game device starts the separate game, a result of which is determined by a value of the generated random number, and the separate game will finish with the determined result.

As mentioned above, a specific result of the separate game initiated by the entrance of a game ball into the starter hole is determined by the probability of a predetermined value of the random number generated. Therefore, the result of the separate game is according to a certain probability, while payment of prize balls based on the separate game can be controlled without the adjustment of nails as in the prior art.

In addition, if a variable or changeable winning device is provided, a specific result of the separate game for converting the variable or changeable winning device to a state advantageous to a player, is determined according to the value of the random number produced by the random number generating means, and such value of random number is based on a predetermined probability. Therefore, chances for changing the state of the variable or changeable winning device to provide big scores to a player, can be given impartially.

DETAILED DESCRIPTION OF THE PREFERRED EMBODIMENT

Figure 1:
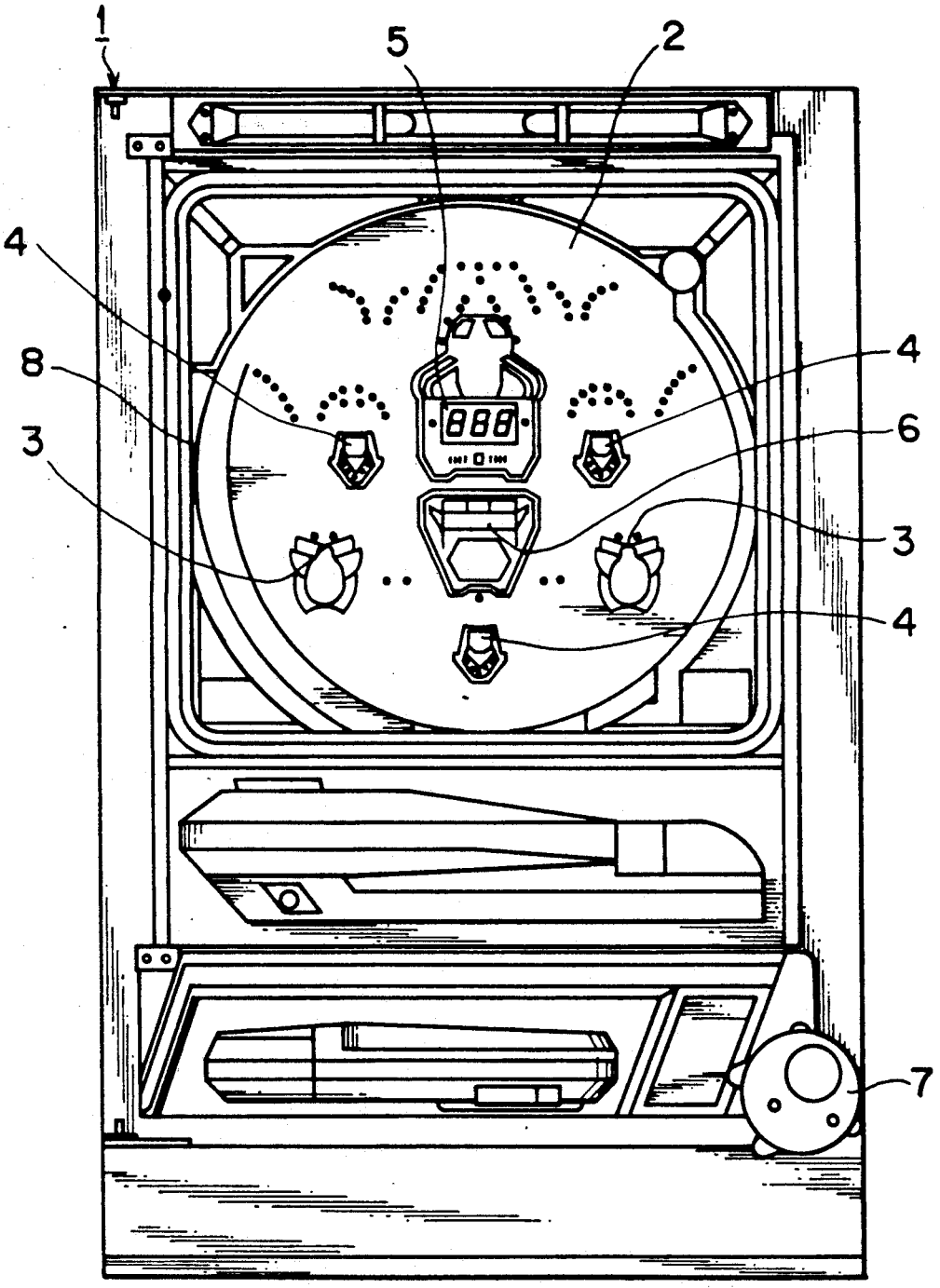
FIG. 1 is a front view showing a pachinko game machine according to one embodiment of the invention.

FIG. 1 is a front view of a pachinko game machine as an embodiment of the invention. The pachinko game machine 1 includes a game board surface 2 with two variable winning devices 3, each of which can be alternately converted between a first state where a game ball shot from a ball shooter (described hereinafter) to the game board surface 2 can not enter therein, and a second state where the game ball can enter. The variable winning devices 3 are provided on right and left sides, and three starter holes (chuckers) 4, each of which initiates a separate game when a game ball enters, are provided on the right side, central lower position and left side. The game board surface 2 also has a variable display device 5 disposed in the center and a changeable winning device 6 with a door, which opens if the variable display result in a special display state, disposed under the variable display device 5. In the embodiment, the separate game includes not only variable display of the variable display device 5 as described below but also conversion of the state of the variable winning devices 3.

The game board surface 2 has a plurality of nails 3 arranged as guide means such that game balls shot from the ball shooter may be guided to positions over the variable winning devices 3 and starter holes 4. A ball shooting handle 7 is provided on a right lower portion of the front of the machine. When the handle 4 is operated by a player, game balls are shot from the ball shooter mounted on the back side of the game board so as to shoot a ball along a guide rail 8 on the game board surface 2.

Figure 2:
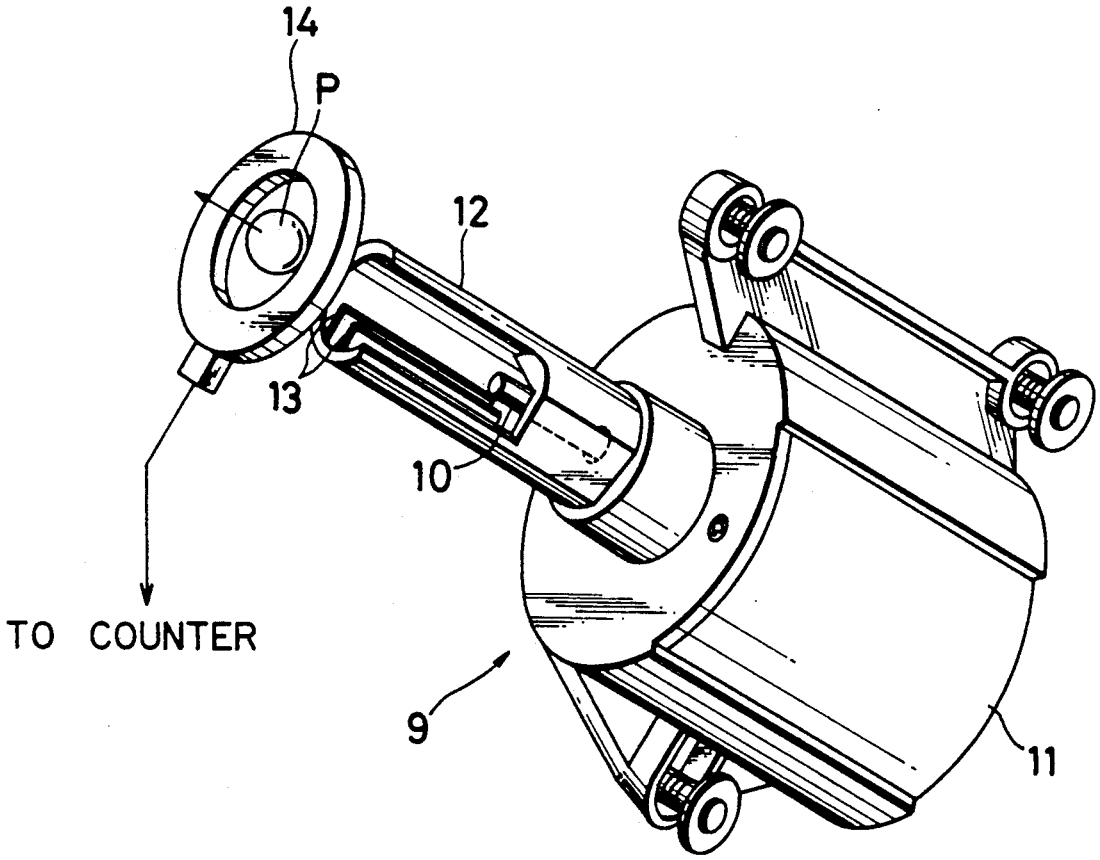
FIG. 2 is a perspective view showing examples of a ball shooter and a shot ball sensor.

FIG. 2 shows an example of the ball shooter. This ball shooter 9 comprises a ball shooting section 11 including a solenoid for protruding a plunger 10 (activated by an electromagnetic force) to shoot a ball P and a ball guide section 12 provided on the side, through which the plunger 10 is protruded. The ball guide section 12 consists of a cylindrical member with a cutout at a forward portion so as to feed a ball P therethrough. The cylindrical member is provided, on its inner bottom surface, with a pair of parallel guide ridges 13 for forwardly guiding a ball P kicked by a tip of the plunger 10.

A shot ball sensor 14 is disposed in front of the ball shooter 9 to detect each ball P shot by the ball shooter 9. The shot ball sensor 14 consists of a magnetic sensor with a hole through which each shot ball P will pass. The output of the shot ball sensor 14 is supplied to a shot ball counter 18 (FIG. 3) as described below.

Figure 3:
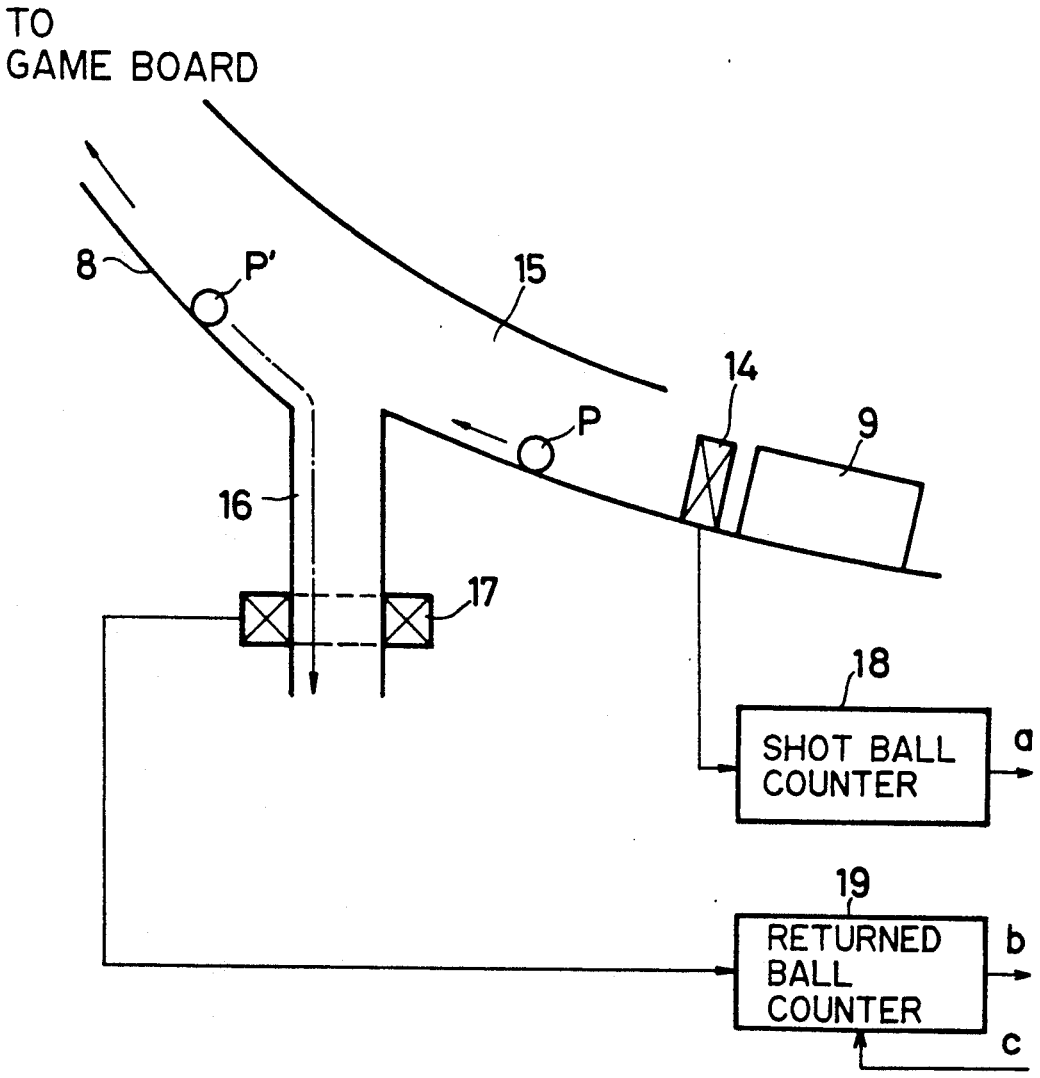
FIG. 3 is a view showing a method of detecting shot balls and returned balls.

Each ball P shot from the ball shooter 9 is guided along a guide rail 8 defining a shot ball path upwardly to an upper portion of the game board surface 2 as shown in FIG. 3. A returned ball P', which does not reach the game zone of the game board surface 2 will return to the ball shooter 9, via a recovery path 16. A returned ball sensor 17 is disposed on an intermediate portion of the recovery path 16 to detect such returned balls. The output of the returned ball sensor 17 is supplied to a returned ball counter 19. Thus, the game balls (returned balls), which have been returned to the ball shooter 9 without reaching the game zone over the game board 2, are counted as shot balls.

The shot ball sensor 14, the returned ball sensor 17, the shot ball counter 18 and the returned ball counter 19 constitute a shot ball detector 20 connected to a circuit of FIG. 4 (described below). The count of the shot ball counter 18 increases by one every time the shot ball sensor 14 detects a shot ball P, while the count of the returned ball counter 19 increases by one every time the returned ball sensor 17 detects a returned ball P'.

The shot ball detector 20 is not only a detector for detecting each shot ball by a signal from the shot ball sensor 14, but may also be constituted such that the shot ball sensor 14 is disposed at a shooting position for a game ball, and the sensor 14 outputs a shot ball detecting signal if it detects a signal for activating the shooter device 9 during detection of a game ball. According to this system, the shot ball is detected the first time the ball shooter 9 is actuated under a condition where a game ball is in the shooting position, thus it is possible to make a sure detection of an actually shot ball.

The circuit of FIG. 4 generates a random number in response to a detection signal from the shot ball detector 20, and initiates the separate game if a game ball enters into one of the starter holes and finishes the separate game with a specific result if the random number matches a predetermined number, as described later. In the embodiment, as a result of the separate game, the variable display of the variable display device 5 is stopped to a specific display, for example, numerals "777" displayed in three display windows. Otherwise, a plurality of variable winning devices 3 are variably driven in a specific manner. (For example, all of them are simultaneously or alternately changed to the second state.)

The variable winning device 3 includes a pair of pivotable members disposed on the game board surface 2, for the purpose of creating either a state advantageous to the player or disadvantageous to the player. The variable winning device can assume a first state whereby it is not possible or difficult to produce a winning ball if the pair of pivotable members are closed, while the variable winning device 3 can assume a second state whereby it is easy to produce a winning ball if the pair of pivotable members are opened. A solenoid device 30 (FIG. 4) in the back side of the game board drives the pair of pivotable members which are constructed to be opened if the solenoid is electrically energized and to be closed if the solenoid is deenergized.

Although such variable winning devices are known, constructions other than its known construction may be utilized. For example, there may be used a variable winning device including a stick-like winning restricting member which can appear or disappear in an upper portion of a winning hole on the game board surface to convert between a first state where a game ball can not or only with difficulty enter the winning hole, and a second state where a game ball can easily enter the winning hole. In a like manner, another kind of variable winning device can be used which can transfer a winning hole on the game board surface between a position (first state) where a game ball can not or only with difficulty enter the winning hole and another position (second state) where a game ball can easily enter the winning hole.

The starter hole 4 for initiating the separate game may be a usual winning hole or pass-through type "chucker". A variable winning device may also be used. As a starter hole ball sensor 23 (FIG. 4) for detecting a game ball which enters or passes through such starter hole, a magnetic sensor with a hole may be used, which a game ball passes through, as in the shot ball sensor 14 mentioned above. An output of the sensor 14 is sent to a controller section 25 described later.

The variable display device 5 comprises a plurality of (for example, three) seven-segment LED (light emitting diode) display devices for variably displaying numerals. A display drive circuit 26 is connected to the LED display devices and is controlled by an output signal from the controller section 25 shown in FIG. 4. The display device may display not only numerals but also characters, figures, and the like.

The changeable winning device 6 is a so-called "attacker". As shown in FIG. 5, the attacker includes a trapezoidal front plate 61 with an opening 62 at an upper portion and a door 63 of an almost same shape as the opening, attached openably and closeably in a front side of the opening 62. In the opening 62, a winning hole 64 is provided and a winning ball sensor 41 (FIG. 4), as described later, is also provided to detect a game ball entering the winning hole 64. The door 63 of the changeable winning device 6 is opened or closed by a drive mechanism (not shown) including a solenoid 43 (FIG. 4) as a driving source disposed in a back side of the front plate 61.

Next, an electric circuit section of the embodiment will be described.

Figure 4:
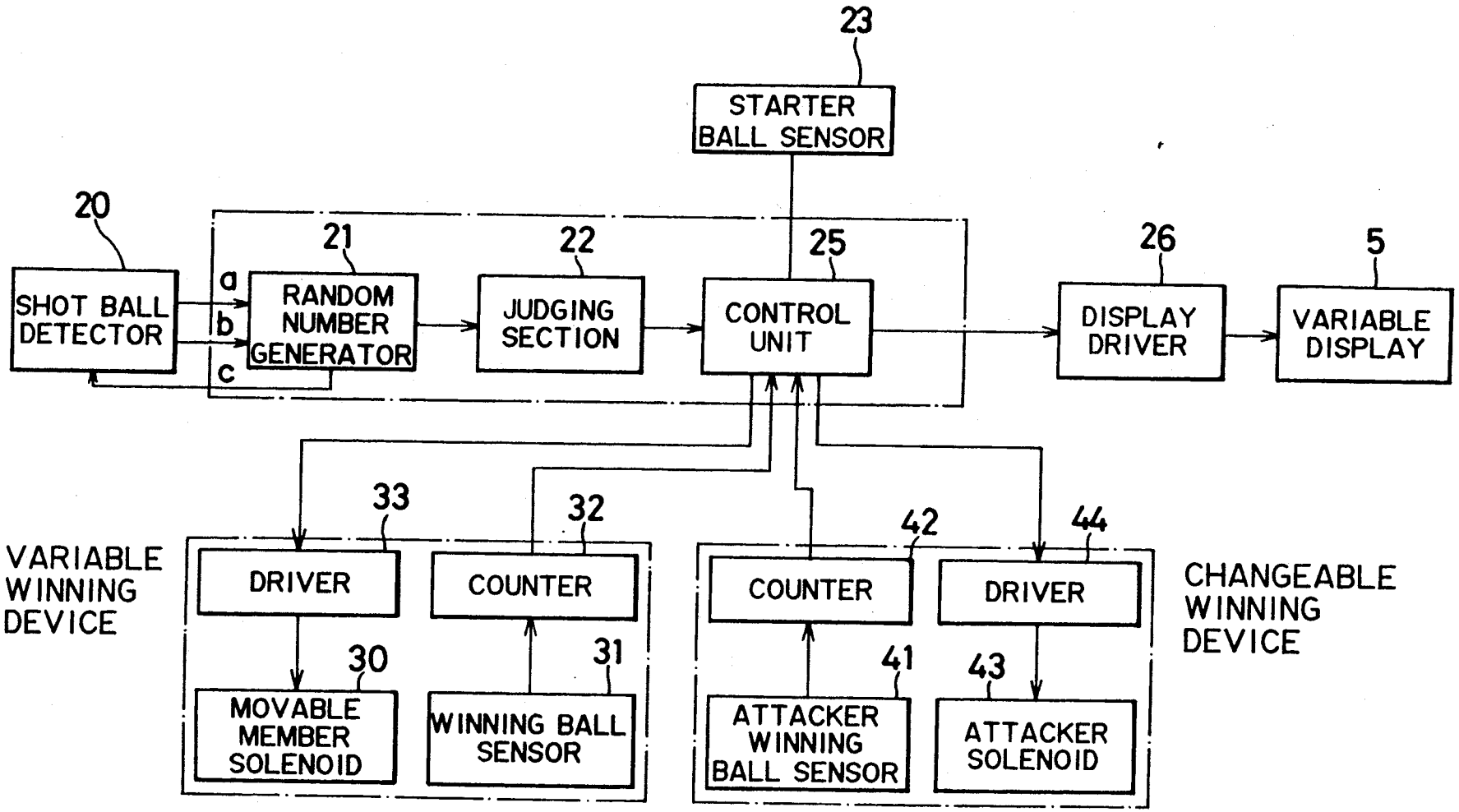
FIG. 4 is a block diagram showing an electric circuit section of the embodiment.
Figure 5A:
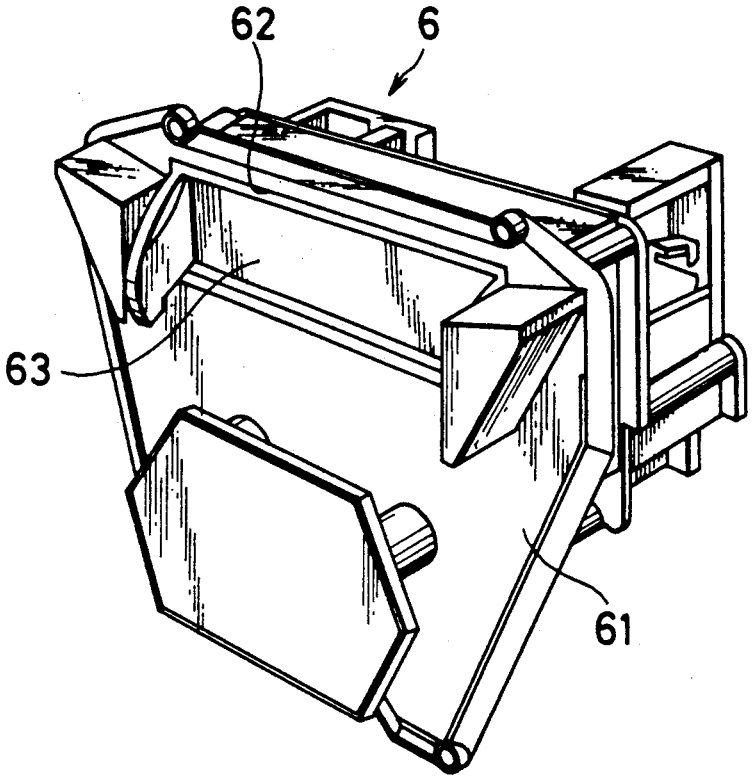
FIGS. 5(A) and 5(B) are perspective views showing an example of changeable winning device.
Figure 5B:
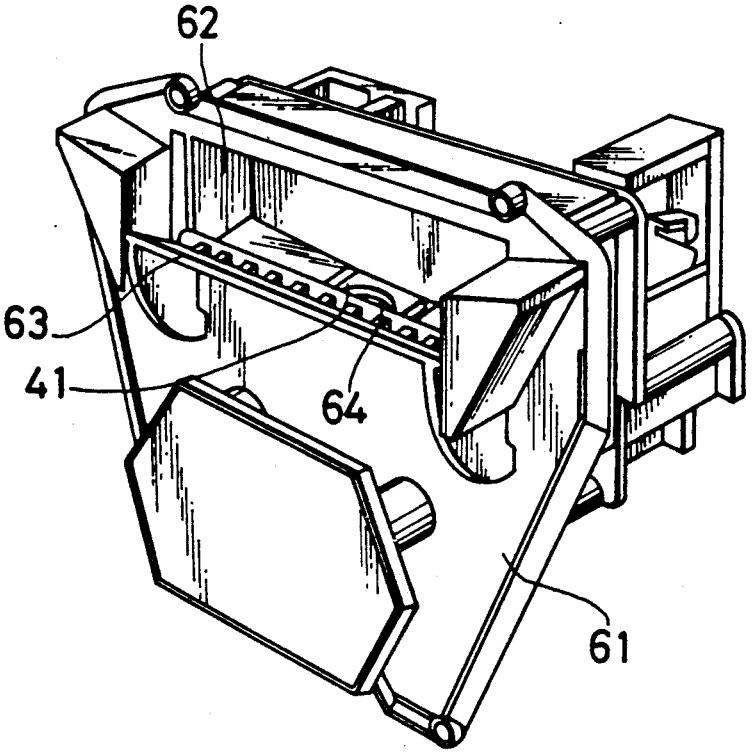

As shown in FIG. 4, the circuit section comprises a random number generator 21 for producing a random number according to output signals and b from the shot ball counter 18 and the returned ball counter 19 of the shot ball detector section 20, a judging section 22 for judging a value of generated random number, and a control unit, or section 25, for initiating the separate game in response to a signal from the starter hole ball sensor 23 and for controlling the variable display device 5 to finish with at predetermined result in response to the judged value of the random number.

A winning ball sensor 31 and a winning ball counter 32 are provided as winning ball detection means for detecting a winning ball which enters into any one of variable winning devices 3. The winning ball sensor 31 consists of a magnetic sensor with a hole which a game ball can pass through. It can detect the winning ball from a change of magnetic field produced if a ball from the variable winning device passes through the hole. It is of course possible to use a sensor other than the magnetic sensor, such as an optical sensor, a microswitch, etc. Detection signals from the winning sensor 31 are supplied to the winning ball counter 32 which counts winning balls. Further, a drive circuit 33 for driving the solenoid device 30 is provided for each of the variable winning devices 3, respectively.

For the changeable winning device (attacker) 6 there are provided an attacker winning ball sensor 41 and a winning ball counter 42 as detection means for detecting a winning ball entering into an inner winning hole. The winning ball sensor 41 consists of a magnetic sensor similar to the winning ball sensor 31 and is disposed in a winning ball exhaust path of the attacker. A detection signal from the attacker winning ball sensor 41 is supplied to the winning ball sensor 42 which counts the winning balls. Further, there is provided a drive circuit 44 which drives a solenoid 43 for driving the door of the attacker.

In the circuit of FIG. 4, the random number generator 21 makes a predetermined calculation to produce a random number every time the count of the shot ball counter 18 is increased by one. However, under a condition where the count of the returned ball counter 19 is "0", if the count is "1" or more, the random number generator 21 does not produce any random number. For example, if the count of the returned ball counter 19 is "2", the count output of the shot ball counter 18 is passed (i.e., no random number is produced) twice from the time of appearance of the count "2", and the random number generator 21 outputs a signal c to decrease the count of the returned ball counter 19 by that number of times to "0".

If the random number produced by the random number generator 21 meets a predetermined number, the display of the variable display device 5 is finished at the specific result, a probability of which, for example, can be determined as follows: If one hundred game balls are shot in a minute and the special "hit" display "777" for providing a relatively large number of prize balls appears once every thirty minutes, the probability is one three thousandth. In this case, a range of random number generation per one shot ball would be 1 to 3,000 and one of these numbers would be set to a value for the "hit" display.

The judging section 22 judges whether or not the random number produced by the random number generator 21 meets any number within the predetermined range.

If the random number judged by the judging section 22 meets a specific value, the control section 25 controls the variable display device 5 to stop at a specific display for the separate game initiated by entrance of a game ball to the starter hole 4. In other words, if the random number judged by the judging section 22 meets the specific value, the control section 25 memorizes it. Then, if a game ball enters into the starter hole 4 and the starter hole ball sensor 23 outputs a detection signal, the control section 25 feeds a signal to the drive circuit 26 for the variable display device 5 in response to the detection signal to initiate a variable display for the separate game and to stop the display device in a state of specific display after a predetermined time.

To exemplify the above, if the separate game results in a "hit", the control section 25 feeds a signal for stopping the variable display in the hit display "777" to the drive circuit 26 and simultaneously feeds another signal to the drive circuit 44 for the changeable winning device 6 to make the door open for a predetermined time by predetermined times. If the separate game results in other than "hit", that is, "miss", the variable display device 5 is stopped in a display for other than "hit". Also, it is possibly to vary a number of prize balls gained by a player by classifying the "hit" into "big hit", "middle hit", and "small hit" (in which probabilities are determined by corresponding ranges of random number, respectively), and by stopping the variable display device 5 in a display corresponding to a kind of "hit" and changing the time and times of opening of the door.

In the pachinko game machine of the embodiment as mentioned above, the separate game is initiated by entrance of a game ball shot on the game board into the starter hole 4, the result of the separate game being previously determined by the random number generated on shooting the game ball.

In the circuit of FIG. 4, though the random number generator 21, judging section 22, and control section 25 are implemented by conventional electronic circuits, respectively, a microcomputer can be used for executing operations of such components.

In this case, the microcomputer is programmed such that it produces a random number whenever a predetermined number (for example, one) of balls is shot, judges which is the random number "hit" or miss", and sets a flag "1" if the generated random number is judged "hit", and when the-starter- hole ball sensor 23 outputs a detection signal, the microcomputer outputs a signal for driving the variable display device 5 to stop the variable display in a result corresponding the to the flag and sets the flag to "0".

Even if a flag is set, the separate game is not conducted if no winning ball is produced. Therefore, if a probability of generation of the "hit" random number is set relatively high, then a flag of "hit" is set and next "hit" may be generated before a game ball enters into the starter hole. In this case, the flag is set to "2", then the flag is decreased from 2 to 1 when the subsequent variable display started by the entrance of game ball into the starter hole is finished in the result of "hit", and the flag is decreased from 1 to 0 when the next variable display is finished in the result of "hit".

The use of a microcomputer to set a flag as mentioned above, permits it to determine and memorize a result of the separate game when the shot ball is detected, and to suitably control the separate game initiated by the entrance of a game ball into the starter hole.

Although an embodiment has been described above, the present invention is applicable not only to a pachinko game machine but also to the other ball-shooting game machine such as a smart ball game machine or a mah-jong ball game machine. Also, the construction and position of the starter hole may be varied optionally and the separate game device may include those having any modifications other than the variable display device in the embodiment described.

Thus, a ball-shooting game machine of the present invention is constituted to produce a random number every time a predetermined number of game ball is shot, to a judge a value of the random number, and to determine a result of the separate game initiated with the game ball entered into the starter hole according to the value of the random number, so that the result of the separate game can be according to a predetermined probability. Therefore, chances for obtaining benefit corresponding to the result of the separate game given to a player are suitably controlled without countermeasures such that the starter hole is provided in a position where game balls can enter only with difficulty and even a poorly skilled player can enjoy the ball-shooting game.

What is claimed is:

1. A ball-shooting game machine comprising a ball shooter for shooting game balls onto a game board surface;

a starter hole for initiating a separate game when a game ball shot by said ball shooter enters therein;

a separate game device for conducting said separate game;

a shot ball detection means for detecting a predetermined number of shot balls whenever said predetermined number of game balls is shot by said ball shooter;

a random number generating means for generating random numbers in response to an output signal from said shot ball detection means;

a judging means for judging the value the random number generated by said random number generating means; and a control means for controlling said separate game if a game ball enters into said starter hole and to finish the separate game with a predetermined specific result depending on the value of the random number judged by said judging means.

2. The ball-shooting game machine according to claim 1 wherein said separate game device comprises a variable display device for variably displaying a plurality of numerals, characters or figures, said variable display device being driven to variably display said numerals, characters or figures by signals from said control means if a game ball enters into said starter hole and to stop the variable display with a predetermined specific result corresponding to the value of the random number.

3. The ball-shooting game machine according to claim 2 which included a changeable winning device on said game board surface being changeable between a state disadvantageous to a player and another state advantageous to a player.

4. The ball-shooting game machine according to claim 1 which included a changeable winning device on said game board surface being chargeable between a state disadvantageous to a player and another state advantageous to a player.

5. The ball-shooting game machine according to claim 1 wherein said starter hole comprises a pass-through chucker whereby a game ball must pass therethrough to initiate a separate game.

* * * * *